United States Patent [19]

Mooshammer

[11] Patent Number: 4,964,545

[45] Date of Patent: Oct. 23, 1990

[54] MULTIPATH MACHINE FOR METERING, FILLING AND PACKING A PASTY PRODUCT, ESPECIALLY A SOUP PASTE

[75] Inventor: Alfred Mooshammer, Ratingen, Fed. Rep. of Germany

[73] Assignee: Benz & Hilgers GmbH, Dusseldorf, Fed. Rep. of Germany

[21] Appl. No.: 307,362

[22] Filed: Feb. 6, 1989

[30] Foreign Application Priority Data

Feb. 6, 1988 [DE] Fed. Rep. of Germany ..... 3803677

[51] Int. Cl.[5] ..... G01F 11/00

[52] U.S. Cl. ..... 222/271; 222/148; 222/413; 141/234; 74/65; 198/674

[58] Field of Search ..... 222/148, 236, 237, 263, 222/271, 410, 412, 413; 198/494, 495, 657, 671, 674; 141/91, 234, 236, 242, 244; 74/65, 68

[56] References Cited

U.S. PATENT DOCUMENTS

| | | | |
|---|---|---|---|
| 2,687,244 | 8/1954 | Peterson . | |
| 2,694,256 | 11/1954 | Coon, Sr. et al. | 222/271 |
| 3,335,768 | 8/1967 | Lense | 222/412 |
| 3,512,683 | 5/1970 | Frisbie | 222/271 |
| 3,658,212 | 4/1972 | Ullberg . | |
| 4,275,808 | 6/1981 | Bullivant et al. | 222/413 |
| 4,493,442 | 1/1985 | Hanson, Jr. | 222/412 |
| 4,730,648 | 3/1988 | Walter | 222/309 |
| 4,842,026 | 6/1989 | Nordmeyer et al. | 222/148 |
| 4,844,296 | 7/1989 | Hayashi et al. | 222/413 |

FOREIGN PATENT DOCUMENTS

| | | | |
|---|---|---|---|
| 510995 | 5/1952 | Belgium . | |
| 2341007 | 3/1975 | Fed. Rep. of Germany | 222/413 |
| 509455 | 1/1955 | Italy | 222/413 |
| 344669 | 2/1960 | Switzerland . | |
| 558739 | 12/1974 | Switzerland . | |
| 475576 | 11/1937 | United Kingdom | 222/413 |

OTHER PUBLICATIONS

Benhil, Jagenberg, Verpackungstechnik, (Benz & Hilgers GmbH), Fully Automatic Filling, Wrapping and Collecting/Stacking Machine, Typ 8358/8535.

*Primary Examiner*—H. Grant Skaggs
*Assistant Examiner*—Steve Reim
*Attorney, Agent, or Firm*—Herbert Dubno; Andrew Wilford

[57] ABSTRACT

The multipath filling machine or unit for metering, filling and packing pastry products, especially soup pastes, in two or more product rows has a feed mechanism, which has a conveying device, and a following metering mechanism. The conveying device has a plurality of conveyor screws extending in pairs to a pressing chamber of the metering mechanism. These conveyor screws are associated with a common entrance funnel for all rows of products so that a uniform product distribution, is attained in the narrowest space and thus an exact metering over.

15 Claims, 4 Drawing Sheets

MULTIPATH MACHINE FOR METERING, FILLING AND PACKING A PASTY PRODUCT, ESPECIALLY A SOUP PASTE

FIELD OF THE INVENTION

My present invention relates to an apparatus or machine which provides measured amounts of a pasty product, especially a soup paste, and fills and packs containers with this highly viscous pasty product.

BACKGROUND OF THE INVENTION

A multipath machine for metering, filling and packing a pasty product, especially a soup paste, in two or more rows of product is known with a feed mechanism having a conveying trough or device with at least one conveyor screw and a subsequent metering mechanism with one mouthpiece associated with each product row.

A two-path machine or unit is common in practice, in which a metering piston of a metering mechanism for each line or row of product is fed by a conveying trough or device for uniform filling of products in two lines or rows. In a machine with more than two paths, space and supply problems develop, since the arrangement may not be further duplicated because of various structural considerations. Also a uniform feed of product to all product rows over the entire machine width cannot be guaranteed.

OBJECTS OF THE INVENTION

It is the principal object of the invention to provide a compact multipath machine or unit for metering, filling and packing a pasty product, especially a soup paste, having more than two rows or lines of product, which has a uniform product distribution and thus over the entire width of the machine packages or fills exactly reproducible amounts of product in each row or line.

Another object is to provide a multipath machine for the purposes described which is free from drawbacks of the earlier filling and packing apparatus.

SUMMARY OF THE INVENTION

These objects and others which will become more readily apparent hereinafter are attained in accordance with my invention in a multipath machine for metering, filling and packing a pasty product, especially a soup paste, in more than two product rows with a feed mechanism having a conveying trough or device with at least one conveyor screw and a following metering mechanism with a respective mouthpiece associated with each of the product rows.

According to my invention, at least one conveyor screw is associated with each of the product rows and a common entrance funnel is provided for all product rows. With my machine a satisfactory uniform distribution of amounts of product occurs under pressure over the entire width of the machine with the same careful processing of product.

Advantageously, a distributing screw extends across an entrance funnel which forms a single structural unit with a housing having the conveyor screws, while the conveyor screws are placed inside the housing substantially perpendicular to the distributing screw.

A uniform lateral filling over the entire width of the entrance funnel is possible when the distributing screw is mounted inside the entrance funnel beside the upper portion of the conveying screws, so that the product mass cannot subsequently slip so that the force of gravity has additional assistance.

When a conveyor screw pair is associated with two adjacent product rows and the conveyor screws extend in pairs to a pressing space of the metering mechanism, there is attained in a simple way a uniform pressure over the entire machine width, which contributes to a satisfactory filling. Only the one conveyor screw of a pair of conveyor screws is advantageously driven by a positioning mechanism of the drive mechanism having a stepping drive and the other conveyor screw needs only to be connected with the driven conveyor screw so that it can also be driven.

Thus it is advantageous, when the axles belonging to a pair of conveyor screws extending from the entrance side of the housing to the outlet side converge toward each other. Thus the product feed is quite satisfactory with this type of mechanism. When the converging conveyor screws have discontinuous or broken screw flights in their upper portions and continuous or unbroken flights in their lower portions advantageously clumps, clogging cakes of product or the like may be more easily broken up so that a more uniform action is attained suitable for driving the conveyor screws and has a movable strip and a plurality of lever arms each driving the respective driven conveyor screws. The movable strip may be slidably mounted in a guide located in the upper side of the housing.

The control rod is advantageously movable. For this purpose, the driven end of the movable strip is connected with a connecting rod, which is also connected at its other end pivotally and continuously movable in a receptacle-containing lever, which for its part, if necessary with a piston-cylinder-unit interposed, is connected with a drive rod of a drive mechanism. The control rod can be acted on with the piston-cylinder-unit, without engaging the entire machine drive. This is done at the beginning of a new product filling or at the end of a product filling.

A fine adjustment for each pair of conveyor screws may be similarly provided. For this purpose, the connection between each lever arm and the movable strip is adjustable, advantageously by a pin-slot-connection, in which several pins, each of which is associated with one of the lever arms, are guided in the receptacle-containing pieces of the movable strip. The smaller the radius from the pin axis to the pivot point of the lever arm, the larger is the adjusting stroke or displacement for the driven conveyor screw, while in the reverse case the displacement of the driven conveyor screws is smaller.

Further, it is important, that the product guide system accord to my invention is at least CIP-cleanable to a limited extent. For this purpose, the housing and the entrance funnel are mounted in an adjustable-height supporting frame rigidly anchored in the machine or unit. Advantageously, a plurality of nozzles are mounted in the housing and connected to separate water pipes and air supply pipes or tubes.

BRIEF DESCRIPTION OF THE DRAWING

The above and other objects, features and advantages of my invention will become more readily apparent from the following description, reference being made to the accompanying drawing in which.

SPECIFIC DESCRIPTION

Figure 1:
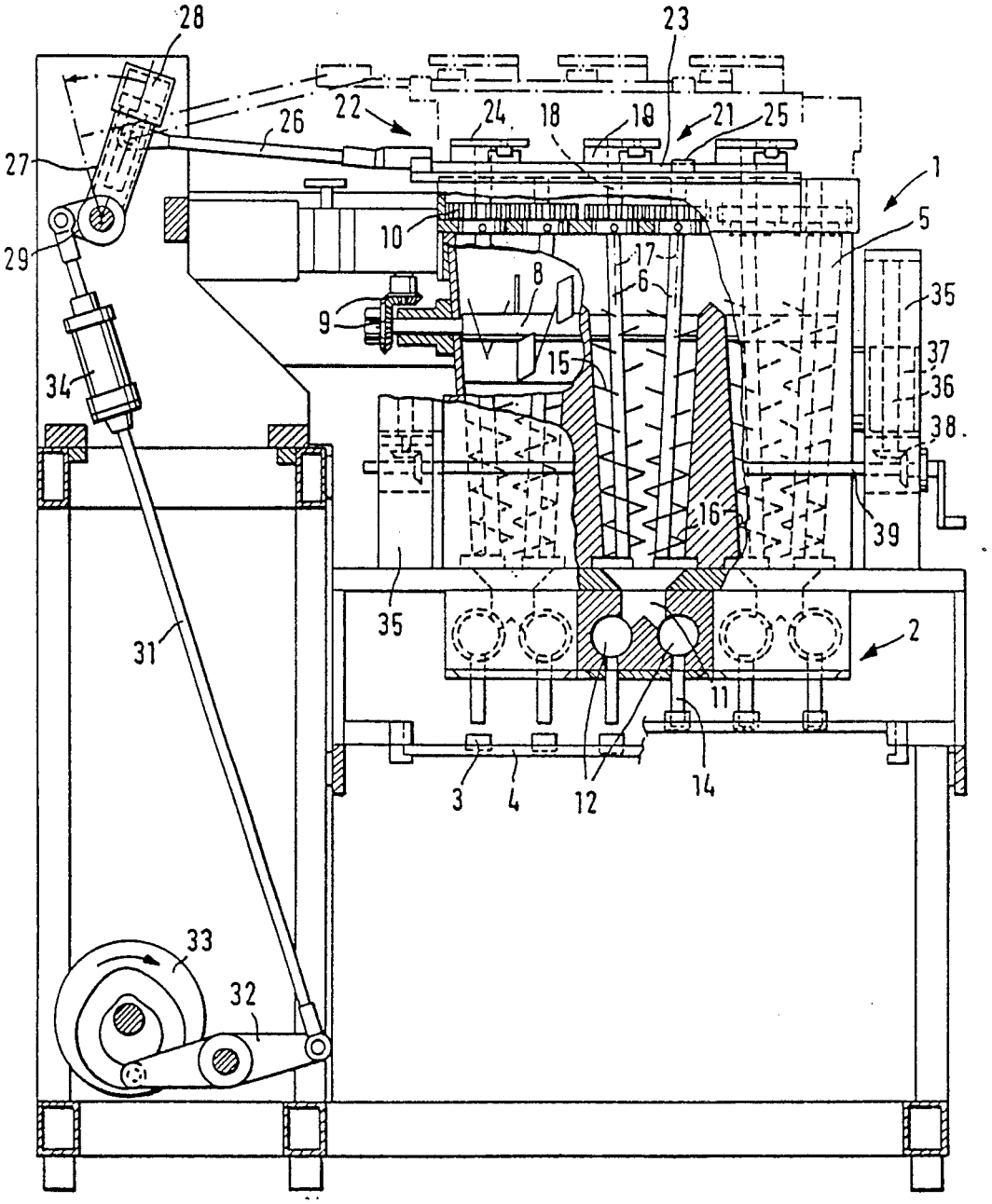
FIG. 1 is a partially cross sectional view through a multipath machine according to my invention.

A six-path machine not illustrated in complete detail in FIG. 1 for metering, filling and packing of a pasty product, especially a soup paste, has a feed mechanism 1 and a metering mechanism 2 in the vicinity of the filling station, by which the product to be filled can be delivered to the product receptacle, e.g. package 3, which sits in a tray divided into cells.

This tray can be moved to and from the individual work stations of the filling machine by a drive (not shown).

In the illustration in FIG. 1 the three left-side product rows are shown prior to filling, while the three right-side rows are shown during the filling process.

Figure 2:
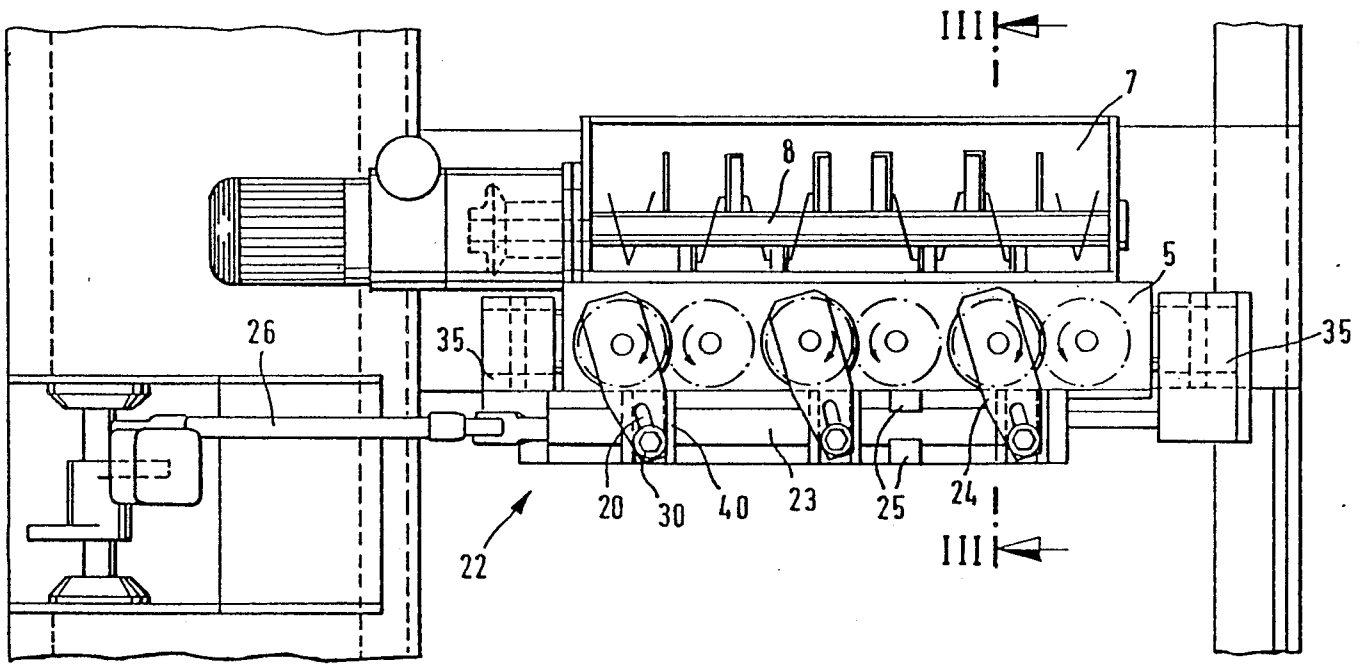
FIG. 2 is a top view of the apparatus shown in FIG. 1.

The feed mechanism 1 comprises a housing 5, in which a total of six substantially vertical screw conveyors 6 are rotatably mounted. The drive of the screw conveyors 6 is illustrated further below. In connection with FIGS. 2 and 3 it is apparent that an entrance funnel 7 is mounted on the housing 5, which forms a structural unit together with the housing 5. A distributing screw 8 is provided extending transversely laterally adjacent the screw conveyors 6. The drive for the distributing screw 8 occurs by a bevel gear drive 9 driven by an unshown bevel gear drive motor.

Figure 3:
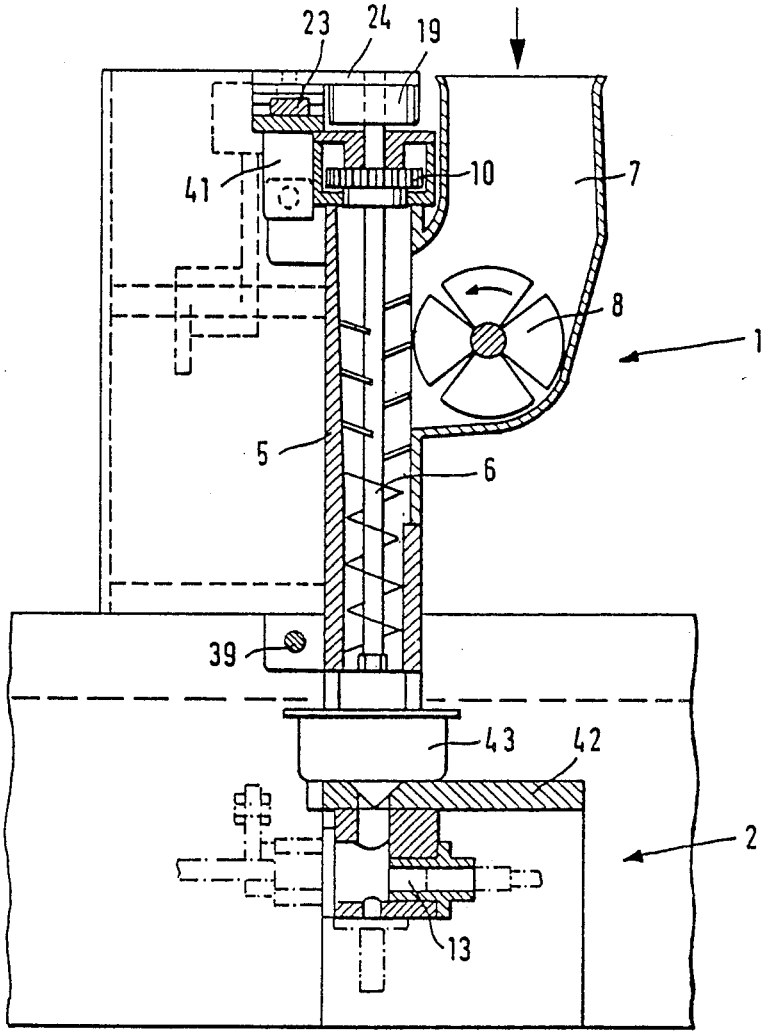
FIG. 3 is a cross sectional view taken along the section line III—III of FIG. 2.

The tapered feed screws 6 extend from the top side of the housing 5 to its lower end to a pressing chamber 11 of the metering mechanism 2. The feed screws 6 are associated pairwise with two adjacent rows of products. That means that one common pressing chamber 11 connects with two adjacent metering chambers 12, from which the product is delivered into the package 3 and/or can be stopped at an outlet or mouth by opening and closing the metering chamber 13 and a mouthpiece 14 connected with it by an unshown rotating disk and a metering piston 13*a* (FIG. 3).

The conveyor screws have broken or segmented screw vanes 15 (discontinuous screw flights) in their upper portion, while they have a continuous screw vane (screw flight) 16 in their lower portion. An additional dividing or comminuting action is provided by the segmented or broken screw vanes.

The axles 17 of each pair of conveyor screws 6 extend from the entrance side to the outlet side of the housing 5 converging downward toward each other. They run substantially in one plane, which is bounded by two adjacent metering chambers 12. The conveyor screws 6 are connected with drive shafts 18 at their upper ends, which cooperate for their part with a stepping drive 19 of a positioning mechanism 21. A control rod 22 belongs to this positioning mechanism 21. It has a movable strip 23 and a lever arm 24 cooperating with stepping drive 19.

The driven end of the movable strip 2 mounted in a guide 25 on the upper side of the housing is connected with a connecting rod 26, whose other end is engaged continuously and pivotally movable in a receptacle-containing lever 27. A piston-cylinder-unit 28 acts to position and move the connecting rod 26 in the receptacle-containing lever 27 (since the end of the connecting rod 26 is engageable in the receptacle of the lever 27). The receptacle-containing lever 27 is rigidly attached to arm 29 mounted pivotable about a substantially horizontal axle. The drive rod 31 is connected to the arm 29. The drive rod 31 cooperates with a rotatably driven cam groove 33 with a connected intermediate lever 32. Another piston-cylinder unit 34 is mounted on the drive rod 31, whose significance is discussed in more detail below.

The housing 5 including the entrance funnel 7 is mounted in an adjustable-height rigid supporting frame 35 anchored in the machine. For this purpose, a positioning spindle 36 is provided, which extends through a guide block 37 connected with the housing 5 and can be operated by a bevel gear drive 38 of a drive shaft 39, which is manually operable.

The second screw conveyor 6 of each screw pair may be driven by a gear 10 mounted on the driven conveyor screw.

For simple construction of a conveyor screw, at least a part of the housing 5 carrying the guide for the movable strip 23 is pivotally mounted on a holder 41.

As seen in FIG. 3, with the housing raised, a product pan 43 can be placed on an intermediate plate 42 of the metering mechanism 2 to remove the residual product from the feed mechanism at the end of production. After that, the cleaning of the machine can proceed.

For the cleaning of the product feed, certain parts of the metering mechanism 2 can be disassembled and the cleaning system installed and/or acted on.

Figure 4:
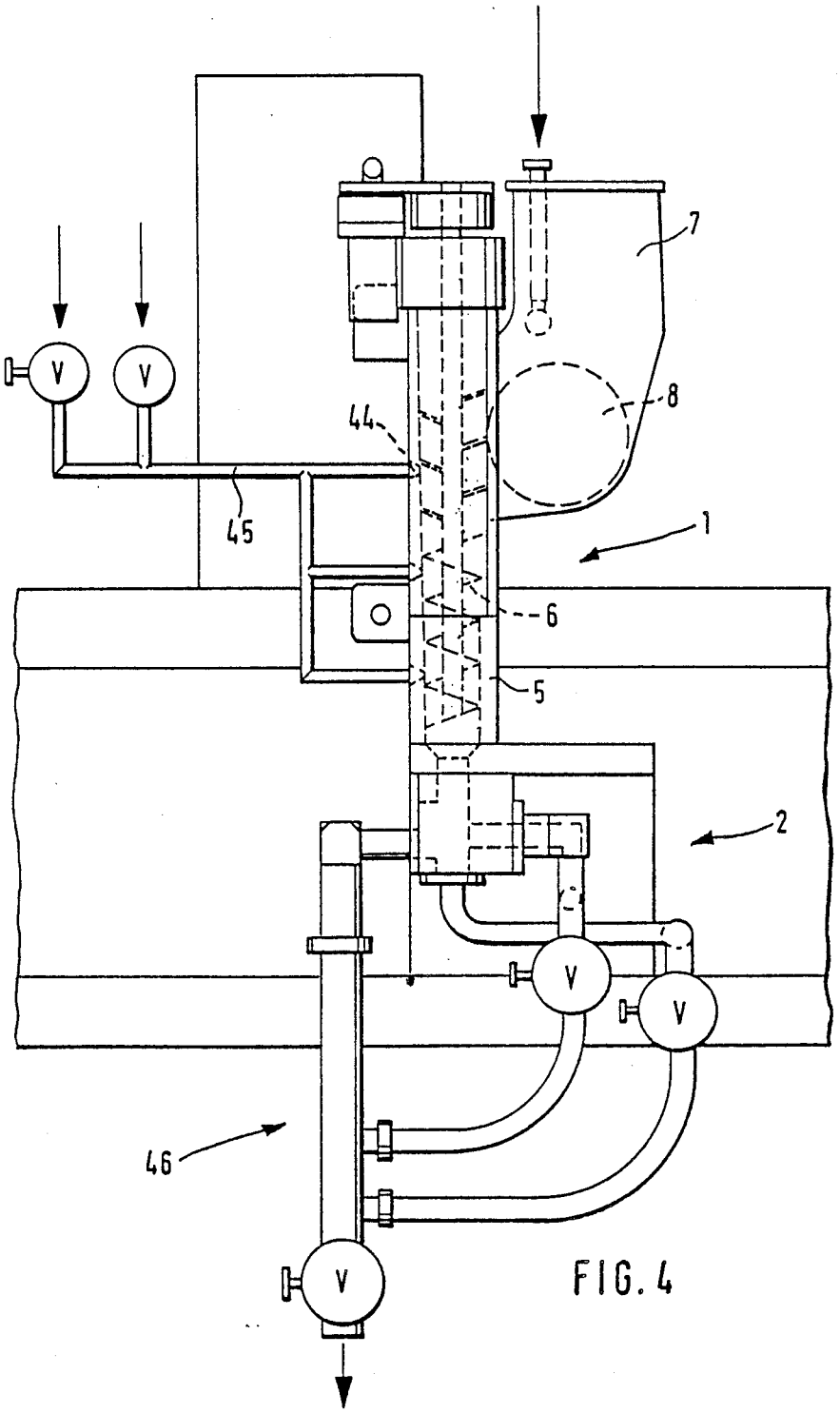
FIG. 4 is a side view of the metering mechanism in the cleaning configuration corresponding to FIG. 3.

In FIG. 4 the cleaning configuration of the product feed is illustrated. The nozzles 44 to which water and/or air guiding tubes 45 are connected are built into the housing 5. A corresponding tube system 46 is built in under the metering mechanism 2 for conducting away the air and/or the water. Also in the vicinity of the entrance funnel 7 an additional water feed can be connected.

The operation of the filling machine according to my invention is as follows:

From a product duct or feed pipe (not shown) the product is delivered to the entrance funnel 7, in which the product is comminuted and prepared by the rotating distributing screw 8. From the distributing screw 8 the product reaches the vicinity of the conveyor screw 6, which grind or break up the product further and feed it to the pressing chamber 11 of the metering mechanism 2. By appropriate action of the metering elements inside the metering mechanism the product then arrives in the metering chamber and is delivered by the metering pistons through the mouthpieces 14 into the packages 3.

The basic adjustment of the rotary motion of the driven conveyor screw 6 occurs by guiding of the connecting rod 26 in the receptacle-containing lever 27. A fine adjustment occurs in the vicinity of the lever arms 24, which are provided for that purpose with an elongated slot 20 and a pin 30 cooperating with it. The pin 30 engages in a receptacle-containing piece 40, which is mounted on the movable strip 23. By independent adjustment of these pin-slot connections each driven conveyor screw of the conveyor screw pair can be adjusted precisely independently of its positioning motion. Thus a uniform product division and metering results.

In the production mode the feed mechanism takes the configuration shown in FIGS. 1. The residual product found in the housing at the end of production is delivered to the product pan 43, which is pushed into the open cavity, which results when the housing 5 is pushed upward against the supporting frame 35.

So that one need not operate the entire drive for the machine, the piston-cylinder-unit 34 is activated and acts on the connecting rod 26 and the movable strip 23 by the receptacle-containing lever 27, so that the product is pumped out from the housing by the repeated action of its pistons. The housing 5 can then be returned to its original position. The cleaning system can be connected and a cleaning can be performed by air. Subsequently the feed mechanism may be cleaned with cleaning fluid.

The invention is not limited to the embodiment which is shown above but may have many variations within the scope of the appended claims. It is also conceivable that one feed screw or conveyor screw be associated with one product row. A pairwise association of conveyor screws with product rows however has certain advantages.

By "drive mechanism" in the following claims we mean the control rod with the movable strip, the drive rod with the interposed piston-cylinder-unit and other piston-cylinder-units and various components required to drive the conveyors screws.

We claim:

1. In a multipath machine for metering, filling and packing a pasty product, especially a soup paste, in more than two product rows with a feed mechanism having a conveying trough with at least one conveyor screw and a following metering mechanism with a mouthpiece associated with one of said product rows, the improvement wherein at least one of said conveyor screws is associated with each of said product rows, a common entrance funnel is provided for all of said product rows, a distributing screw is mounted inside said entrance funnel, extends substantially across said entrance funnel, and is situated adjacent and perpendicular to said conveyor screws, pairs of said conveyor screws extend toward a single respective pressing chamber of said metering mechanism and two adjacent product rows are fed through the respective pressing chamber.

2. The improvement defined in claim 1 in which one conveyor screws of said pair is driven by a positioning mechanism having a stepping drive and the other conveyor screw of said pair is connected with the respective one conveyor screw which is driven by said positioning mechanism.

3. The improvement defined in claim 2, further comprising a control rod and a stepping drive connected with the conveyor screws which are driven.

4. The improvement defined in claim 3 wherein said control rod comprises a movable strip and respective lever arms connected via the respective stepping drives with the conveyor screws which are driven, said movable strip being slidably mounted in a guide located on an upper side of said housing.

5. The improvement defined in claim 4 wherein a driven end of said movable strip is connected with one end of a connecting rod having another end which is pivotally and continuously movably engaged in a receptacle-containing lever which is pivotally connected with a drive rod.

6. The improvement defined in claim 5 wherein the connection between each of said lever arms and said movable strip is adjustable.

7. The improvement defined in claim 6 wherein the housing includes at least one portion carrying said guide for said movable strip and mounted hingedly.

8. The improvement defined in claim 7 wherein said housing and said entrance funnel are attached rigidly to an adjustable-height supporting frame.

9. The improvement defined in claim 8 wherein a plurality of nozzles connected to air- and water-conducting pipes are provided in said housing.

10. The improvement defined in claim 2, further comprising a housing receiving said conveyor screws and said entrance funnel and constructed as one structural unit.

11. The improvement defined in claim 10, further comprising respective axles carrying said conveyor screws and extending from an entrance side of said housing to an outlet side and converging toward each other.

12. The improvement defined in claim 11 wherein an upper portion of said converging conveyor screws has a discontinuous screw flight and a lower portion of said conveyor screws has a continuous screw flight.

13. The improvement defined in claim 12 wherein said axles of each of said pairs of said conveyor screws are located in a region which is bounded by two adjacent ones of said product rows.

14. The improvement defined in claim 6 wherein said connection comprises a pin-slot-connection in which a plurality of pins, each connected with one of said lever arms, are guided in a receptacle-containing piece of said movable strip.

15. A multipath machine for metering, filling and packing a pasty product, especially a soup paste, in more than two product rows, the machine comprising:

a feed mechanism having a conveying trough with at least one pair of conveyor screws, one of which is associated with each of said product rows, one of said pair of conveyor screws being driven by a positioning mechanism having a stepping drive and the other of said conveyor screws of said pair being connected with a drive gear attached to said driven conveyor screws, an upper portion of said converging conveyor screws having a discontinuous screw flight and a lower portion of said conveyor screws having a continuous screw flight;

a housing receiving said conveyor screws and a common entrance funnel with a distributing screw mounted inside said entrance funnel extending substantially across said entrance funnel constructed in one structural unit;

a following metering mechanism having a mouthpiece associated with one of said product rows and a pressing chamber, two adjacent ones of said product rows being fed through said pressing chamber; and a drive mechanism for said driven conveyor screws comprising a control rod connected with said driven conveyor screws, said control rod having a movable strip and a plurality of lever arms connected via the respective stepping drives with the conveyor screws which are driven, said movable strip being slidably mounted in a guide located on an upper side of said housing, a connecting rod attached at one end with a driven end of said control rod, a receptacle-containing lever in which said connecting rod is engaged pivotally and movably which is pivotally connected with a drive rod, each of said lever arms and said movable strip being connected by a pin-slot-connection in which a plurality of pins, each connected with one of said lever arms, being guided in a receptacle-containing piece of said movable strip.

* * * * *